US006093098A

United States Patent [19]

Wilhelmson

[11] Patent Number: 6,093,098

[45] Date of Patent: Jul. 25, 2000

[54] SATELLITE DISK HOUSING AND ROOF VENTILATION DEVICE

[75] Inventor: Jack Lee Wilhelmson, Mt. Pleasant, S.C.

[73] Assignee: South Carolina Research Authority, North Charleston, S.C.

[21] Appl. No.: 09/183,207

[22] Filed: Oct. 30, 1998

[51] Int. Cl.[7] ..... F24F 7/02

[52] U.S. Cl. ..... 454/365; 454/367

[58] Field of Search ..... 454/365, 366, 454/367

[56] References Cited

U.S. PATENT DOCUMENTS

| | | | |
|---|---|---|---|
| 891,312 | 6/1908 | White | 454/365 |
| 5,402,613 | 4/1995 | Giumenta et al. | 52/244 |
| 5,921,863 | 7/1999 | Sells | 454/359 |

FOREIGN PATENT DOCUMENTS

| | | | |
|---|---|---|---|
| 389997 | 2/1924 | Germany | 454/365 |
| 598470 | 10/1959 | Italy | 454/365 |
| 378358 | 8/1932 | United Kingdom | 454/365 |

*Primary Examiner*—Denise L. Ferensic
*Assistant Examiner*—Derek S. Boles
*Attorney, Agent, or Firm*—B. Craig Killough

[57] ABSTRACT

A housing for a television receiver satellite dish has a roof and side walls which form a structure which is attached to the roof of a building. The structure accommodates a television receiver satellite dish. The side walls are made of a radio-frequency transparent material so that reception of the television receiver is not impaired. The structure is further designed to fit over a roof ventilating fan, and has openings in its side walls to allow vented air to escape. The device provides an attractive housing which protects the television receiver satellite dish, and provides roof and attic ventilation for the building.

5 Claims, 4 Drawing Sheets

SATELLITE DISK HOUSING AND ROOF VENTILATION DEVICE

TECHNICAL FIELD

This invention relates to the field of roof ventilation systems, and more particularly, to a cupola structure which is designed to be mounted on an existing roof and can contain both a ventilating fan and a television satellite dish.

BACKGROUND OF THE INVENTION

All roofs of commercial or residential buildings need to be vented to prevent extreme heat and moisture buildup. Types of venting range from the totally passive (openings on the sides of the roof structure) to roof top fan structures that are turned by the rising heated air to electrically operated venting fans.

Another totally different structure that is often attached to a home is a television receiver satellite dish receiver, sometimes know as a television receive only satellite dish. Early satellite receivers were large structures several feet across that we usually placed on the ground in the yard. But improved technology, both in satellite receiver design and operation, has made it possible for highly functional satellite receivers to be made that are 18 inches or so in diameter. These receivers are usually mounted on the wall or roof of a home. Problems with such placement include the possibility of damage to the satellite dish by wind, hail or other extreme weather, and also the possibility of theft of an obvious and valuable item. The present invention affords a way to protect a satellite dish from both view and damage, while at the same time, providing a means for venting an attic fan into the atmosphere.

SUMMARY DISCLOSURE OF THE INVENTION

The protective roof structure of the present invention is a cupola-like structure having a roof, sides, and being open and angled at its base so that it may fit onto an existing roof of a building. The sides are made of radio-frequency, transparent material and are vented. The structure is sized so that it can accommodate a television satellite receiver dish which may be mounted on a platform within the structure or directly on the roof. The structure is designed to sit above a ventilating fan upon the roof by means of which air is exhausted from within the building, into the structure, thence into the atmosphere.

Accordingly, its an object of the invention to provide a structure that will cover and protect a TV satellite receiver dish while not interfering with the reception of radio-frequency signals.

It is a further object of the invention to provide such a structure that can also sit over a ventilation fan placed in the roof of a building and allow an exhaust by the fan from within the building to escape into the atmosphere.

DESCRIPTION OF THE PREFERRED EMBODIMENTS

Like numbers in the figures refer to like features of the invention.

Figure 1:
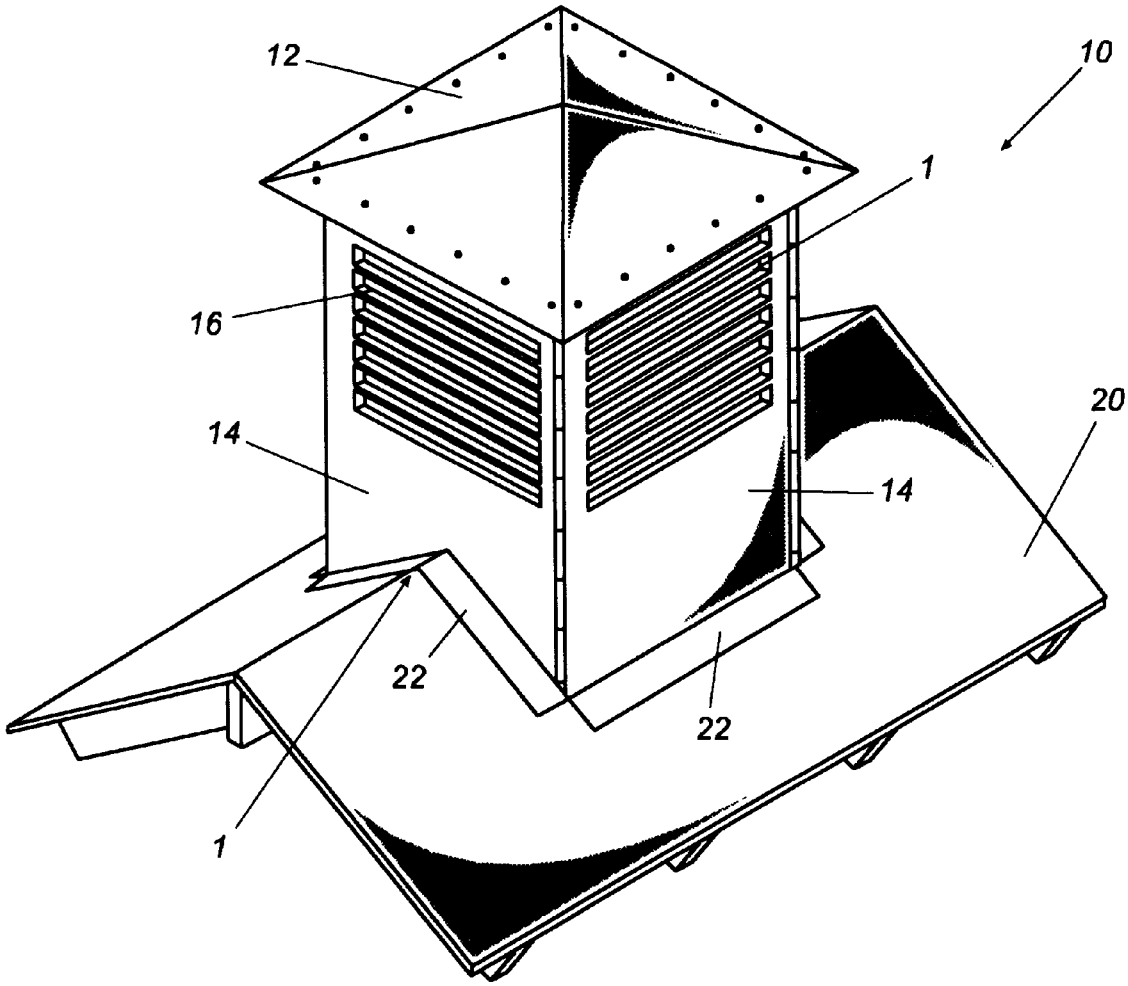
FIG. 1 is an exterior view of the cupola structure of the present invention.

As FIG. 1 shows, cupola structure 10 has structure roof portion 12 and side portions 14. The invention is illustrated as having a traditional cupola-like appearance, but other external appearances to blend with the overall appearance of the home or building to which the structure is to be attached are possible. Structure roof portion 12 and structure side portions 14 are formed of a radio-frequency transparent material, preferably a foam core sandwiched between layers of ABS plastic. Were radio-frequency transparent material not used to form the structure, TV satellite signal reception would be interfered with. Side portions 14 also have formed therein venting slots 16. Lower portion 18 of cupola structure 10 is formed so as to fit onto building roof 20 to which it will be attached by roof flashings 22.

Figure 2:
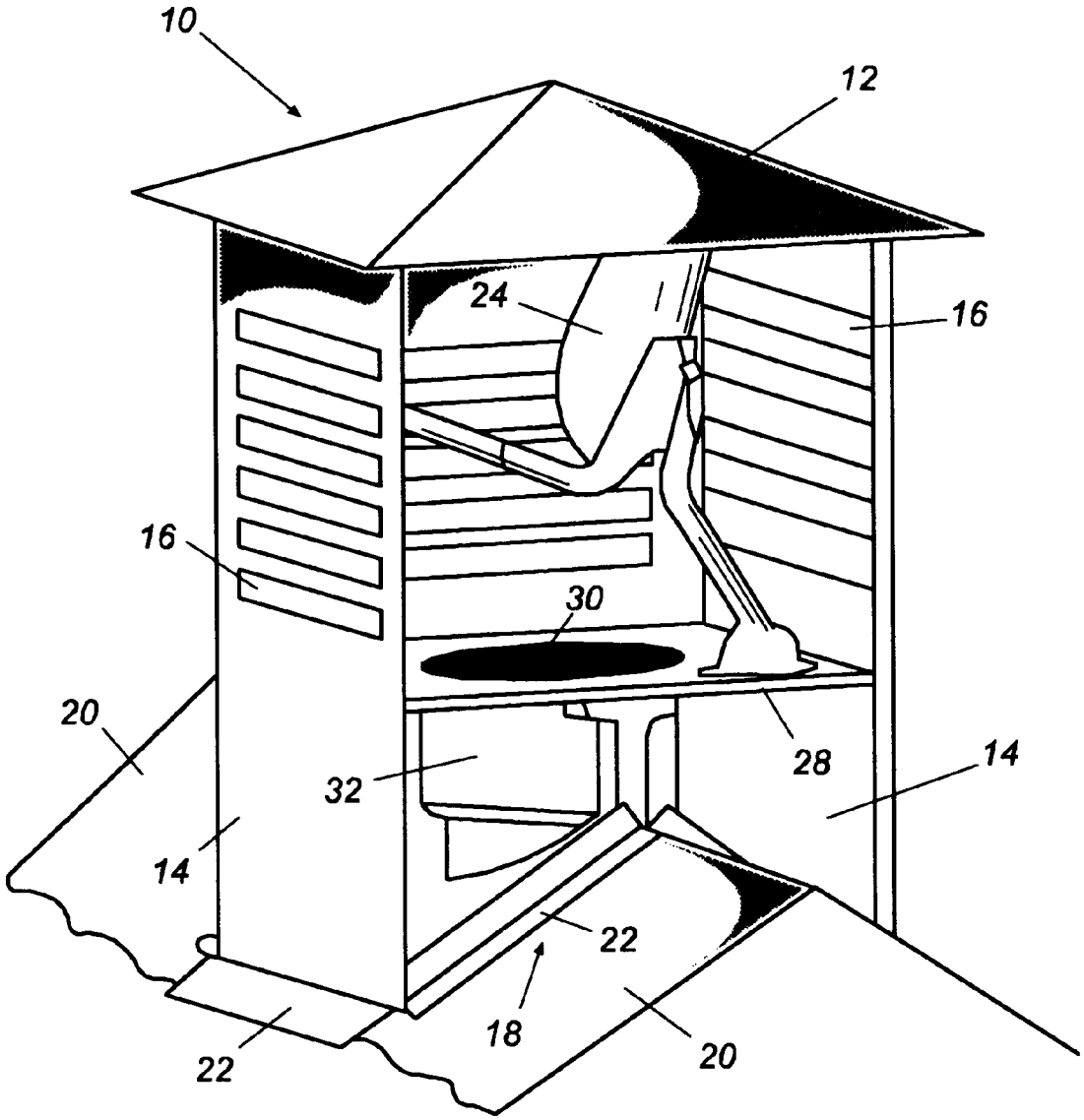
FIG. 2 is a partially exploded perspective of the cupola structure showing the relative locations of the venting fan and the television satellite dish within the cupola structure.

As FIG. 2 shows, cupola structure 10 is sized so that it will fit over and accommodate television receiver satellite dish 24 and ventilating fan 26. Within cupola structure 10 is platform 28, designed so that satellite dish 24 can be mounted thereupon and be oriented toward one side of platform 28. In the center of platform 28 is grill 30 which sits above ventilator fan housing 32 so that air being pulled by the ventilator fan from within the home, is exhausted through grill 30 into the interior of cupola structure 10 from where it escapes through openings in the venting slots 16 into the atmosphere.

Figure 3:
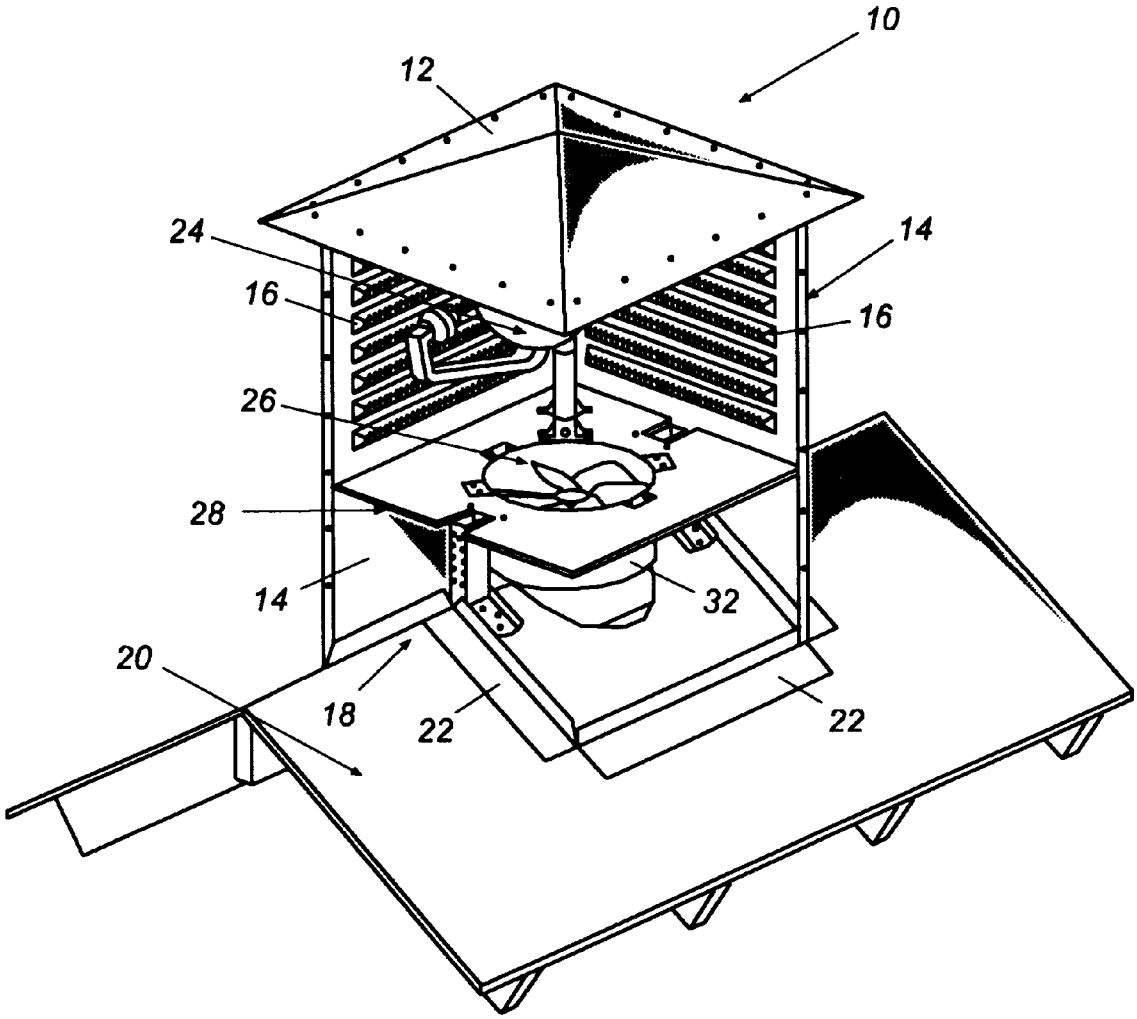
FIG. 3 is a partially cut away perspective of the cupola structure as it is attached to the roof of a building, with the television satellite dish for the venting fan in place.

FIG. 3, similar to FIG. 2 in what it shows, has structure 10 mounted upon roof portion 12. Grill 30 has been removed so that ventilating fan 26 can be seen under platform 28, and ventilator fan housing 32 has been spaced above building roof 20 so the necessary hole through the roof is visible.

Figure 4:
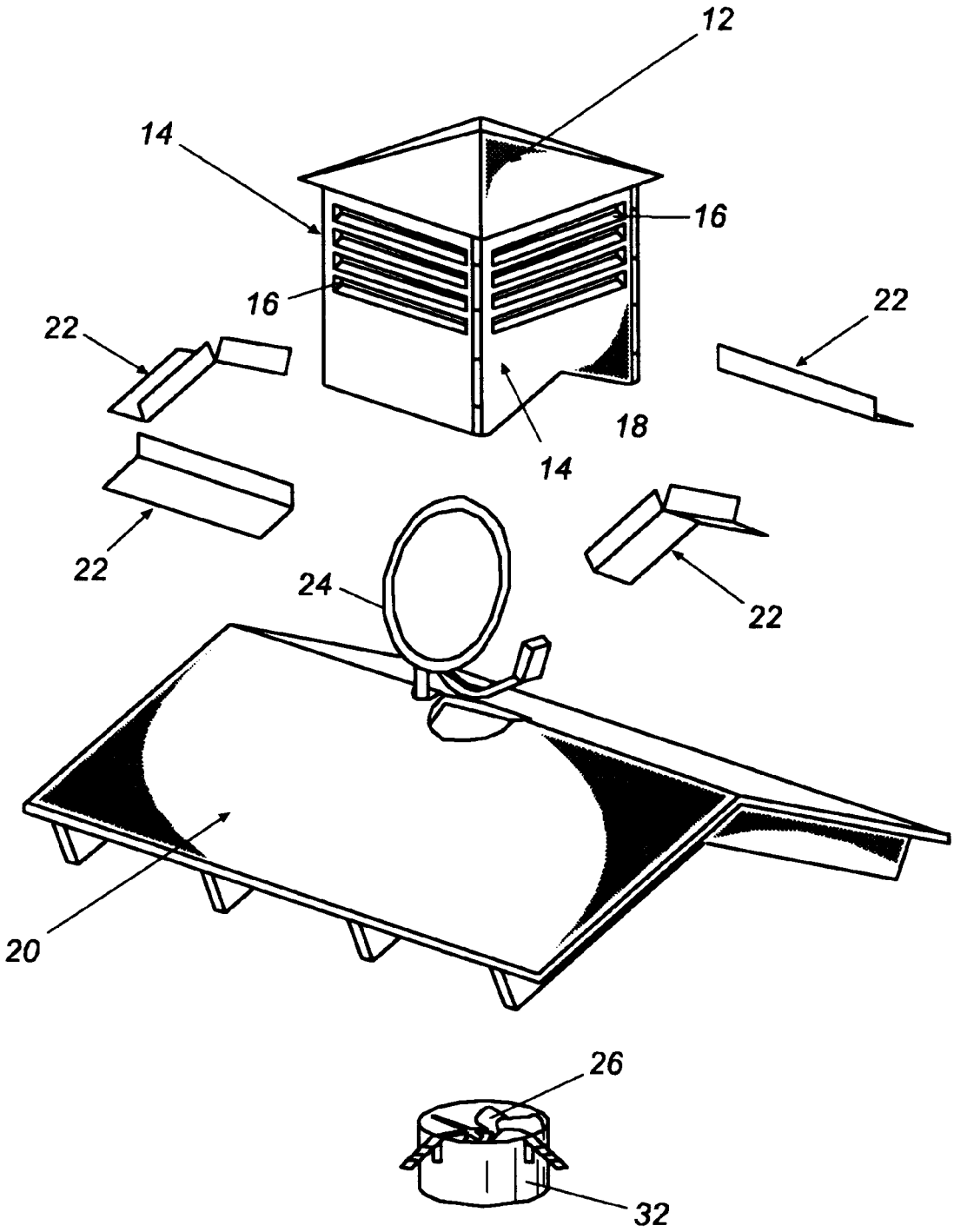
FIG. 4 shows a variation of the cupola structure in a partially cutaway perspective, in which the satellite dish is mounted directly on the roof, and not on the platform within the cupola.

FIG. 4 shows a variation of structure 10 in which platform 28 is missing and satellite dish 25 is mounted directly on (and in) building roof 20.

Other modifications of the protective roof structure of the present invention will become apparent to those skilled in the art from making an examination of the above patent specification and drawings.

What is claimed is:

1. A television receiver satellite dish housing comprising: a generally hollow structure comprising in turn a roof and a plurality of sides, wherein at least one of said plurality of sides has formed therein a plurality of vent holes, and wherein at least one of the plurality of sides is formed of a radio frequency transparent material, wherein the generally hollow structure is formed so as to surround a television receiver satellite dish positioned therein, and wherein the at least one of the plurality of sides formed of a radio frequency transparent material is positioned in front of the feeding face of the television receiver satellite dish.

2. A television receiver satellite dish housing claim 1, further comprising a ventilating fan which communicates with an interior of said generally hollow structure.

3. A television receiver satellite dish housing comprising: a generally hollow structure comprising in turn a roof and a plurality of sides, wherein at least one of said sides has formed therein a plurality of vent holes, and at least one of the sides is formed of a radio frequency transparent material, wherein the radio frequency transparent material comprises a foam core positioned between a first sheet of plastic and a second sheet of plastic.

4. A television receiver satellite dish housing for mounting upon the roof of a building, comprising a generally hollow structure which comprises in turn a roof and a plurality of sides extending from said roof, at least one of said plurality of sides having formed therein a plurality of louvers, said at least one of said plurality of sides being formed of a radio frequency transparent material, the generally hollow structure having within its interior a platform which is connected to at least one side, the platform having an area for mounting a television receiver satellite dish, and having a central open grid which is located over a ventilation fan.

5. A television receiver satellite dish housing claim 4, wherein the at least one of said plurality of sides formed of radio frequency transparent material structure is comprised of plastic.

* * * * *